US005673801A

United States Patent [19]

Markson

[11] Patent Number: 5,673,801

[45] Date of Patent: Oct. 7, 1997

[54] SHELF ORGANIZER DISPLAY

[75] Inventor: Richard Markson, Goshen, N.Y.

[73] Assignee: Markson Rosenthal & Company, Englewood Cliffs, N.J.

[21] Appl. No.: 622,245

[22] Filed: Mar. 25, 1996

[51] Int. Cl.[6] ..... A47F 5/00

[52] U.S. Cl. ..... 211/59.3; 211/184; 211/90; 312/71

[58] Field of Search ..... 211/59.3, 59.2, 211/90, 184, 175; 312/42, 71

[56] References Cited

U.S. PATENT DOCUMENTS

| | | | |
|---|---|---|---|
| D. 344,295 | 2/1994 | Markson . | |
| D. 353,728 | 12/1994 | Markson . | |
| D. 354,184 | 1/1995 | Markson . | |
| 3,028,014 | 4/1962 | Southwick . | |
| 3,658,398 | 4/1972 | Abbate, Jr. et al. . | |
| 4,460,096 | 7/1984 | Ricci . | |
| 4,478,337 | 10/1984 | Flum . | |
| 4,729,481 | 3/1988 | Hawkinson et al. . | |
| 4,762,236 | 8/1988 | Jackle, III et al. | 211/59.3 |
| 4,830,201 | 5/1989 | Breslow . | |
| 5,012,936 | 5/1991 | Crum | 312/71 X |
| 5,217,124 | 6/1993 | Stone . | |
| 5,265,738 | 11/1993 | Yablans et al. . | |
| 5,351,838 | 10/1994 | Flum . | |
| 5,390,802 | 2/1995 | Pappagallo et al. | 211/59.3 |
| 5,450,968 | 9/1995 | Bustos | 211/184 X |
| 5,562,217 | 10/1996 | Salveson et al. | 211/59.3 |

*Primary Examiner*—Robert W. Gibson, Jr.
*Attorney, Agent, or Firm*—Abelman, Frayne & Schwab

[57] ABSTRACT

A shelf organizer is provided for the storage and dispensing of a plurality of individual products. The shelf organizer is connected to the store fixture by a slide assembly which readily permits its movement between a retracted and extended position relative to the store fixture. A plurality of identical shelf dividers are adjustably positioned within the shelf organizer, so as to adjustably provide compartments of a desired width, in accordance with the product being dispensed. Each shelf divider includes a spring biased pusher bar for urging the products within an individual compartment to the forward most, or product dispensing position.

23 Claims, 12 Drawing Sheets

FIG. 20
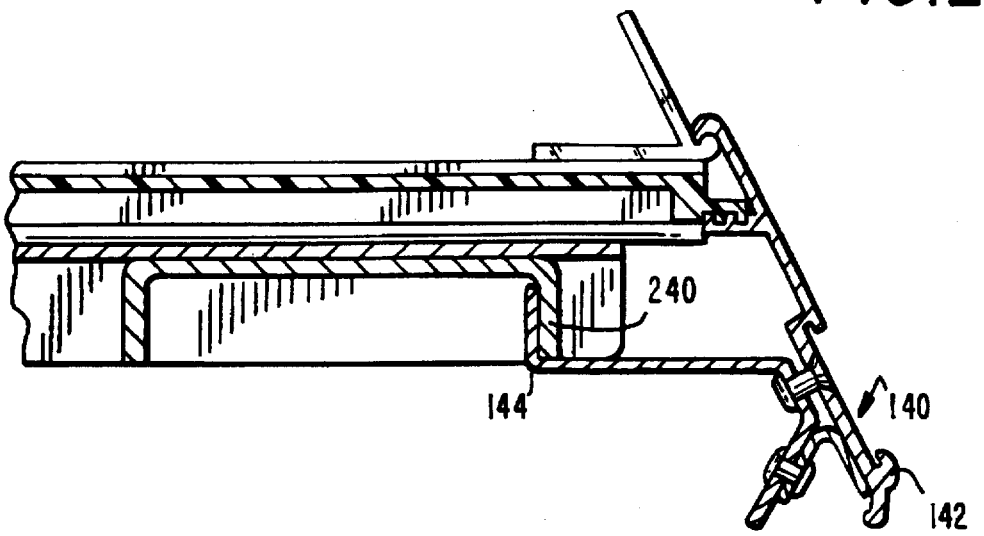
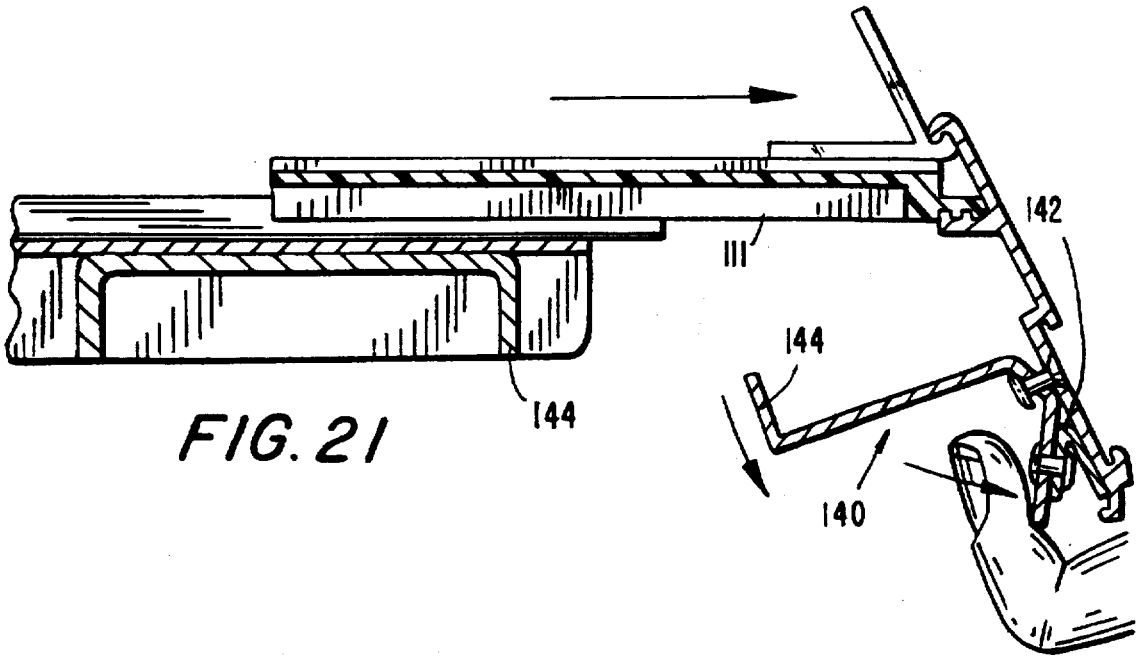
FIG. 21

SHELF ORGANIZER DISPLAY

FIELD OF THE INVENTION

The present invention relates to a shelf organizer for the display and dispensing of products to a consumer. Such displays are intended for attachment to existing gondola type store fixturing typically found in supermarkets, mass merchandisers, pharmacies or other retail establishments. The shelf organizer is intended to be connected to the existing gondola by a slide, which facilitates the accessibility of the shelf organizer for product loading. To maximize the universality of the shelf organizer for accepting different products, it may be adjustably divided into adjacent compartments of desired widths. Each compartment will automatically present the next available product to the front of the shelf organizer for removal by the customer, at which time the next product within that compartment will be automatically moved forward for display and subsequent customer removal. Hence, the shelf organizer, which may be readily secured to existing store fixturing, can be conveniently modified to dispense a variety of products of differing size.

BACKGROUND OF THE INVENTION

Supermarkets, mass merchandisers, pharmacies and other retail establishments present the consumer with a variety of competitive products. In addition to packaging design to catch the consumer's attention, and hence promote product selection, various displays are utilized for attractively and efficiently containing and dispensing the individual packages. One such type of display is intended to be placed upon the shelving of an existing gondola type of store fixture. Typical of such displays are my U.S. Design Pat. Nos. D344,295, D353,278 and D354,184 as well as U.S. Pat. No. Ricci 4,460,096, Hawkinson et al 4,729,481, Flum 4,478,337, Breslow 4,830,201, Yablans et al 5,265,738, and Flum 5,351,838.

Such prior art displays oftentimes are designed to be merely placed upon the shelf of the existing store fixturing and present a rather static display of the products. That is, the unit is initially loaded and thereafter retains the products at their originally designated locations. Hence, when a product is removed, many such shelf organizers do not automatically move the next product forward, so as to facilitate product removal, as well as providing a more attractive product display. Such product displays are oftentimes difficult to reload as products are depleted. While the aforementioned U.S. Pat. Nos. Breslow 4,830,201, Yablans et al 5,265,738 and Hawkinson et al 4,729,481 patents do provide for the forward movement of packaged goods on a display, their dividers, which define the individual product containing compartments, do not permit the degree of versatility, simplicity, and ease of secure assembly of the present display. More specifically, the individual compartmental dividers of Breslow are only secured to the shelf organizer at the forward surface, to a member which is adhesively attached to the display shelf. Yablans et al U.S. Pat. No. 5,265,738 requires different space dividers, and associated pusher bars, for different product sizes, hence limiting subsequent adjustability after initial set up to accommodate different product sizes. Hawkinson et al U.S. Pat. No. 4,729,481 provides individual spring biased assemblies which are magnetically attached to the store fixture shelf and which must be inserted onto the shelf in conjunction with separate divider panels. U.S. Pat. Nos. Ricci 4,460,096, Flum 4,478,337 and Flum 5,351,838 show various other shelf organizers which are compartmentalized, but do not provide for the automatic movement of successive products within a compartment towards the front of the unit as a product is dispensed.

Further, the prior shelf organizers once placed on the shelf are intended to remain stationary relative to the fixture. Hence, should it be decided to restock the shelf organizer, it may be difficult to insert replacement products, particularly at the rear portion of the shelf organizer, should there be minimum clearance between successive shelves of the retail establishment. Thus, while the prior art does provide a variety of shelf organizers to improve product presentation and dispensing, they have certain drawbacks with respect to a) ease of restocking, b) adjustability for different product configurations, c) simplicity and durability of construction, d) ease of mounting to the retail gondola and e) product presentation.

SUMMARY OF THE INVENTION

The shelf organizer of the present invention is intended for the storage and dispensing of a plurality of individual products. It comprises a separate product receiving shelf, having a bottom wall which is mounted to the store fixture by a slide means. The slide means permits the shelf organizer to be moved and retained in either its retracted position, at which time products may be individually dispensed from the front of the product shelf by the consumer, or an extended position wherein the entire area of the product shelf portion is readily accessible for product restocking. A plurality of identical shelf dividers are adjustably and selectively positioned between opposed side edges of the product shelf, so as to form a plurality of successive compartments each having a width corresponding to the product being dispensed in the particular compartment. These shelf dividers extend between front and rear walls of the product shelf, and are securably, but releasably, connected thereto, as by a snap in mechanical engagement at the forward and rear ends of the shelf divider. Advantageously, intermediate supports are also provided for the shelf divider so as to enhance and further rigidize the desired securement of the shelf dividers to the product shelf. Accordingly, the selective and adjustable location of the shelf dividers along the width of the shelf organizer will determine the width of the adjacent compartments which are intended to receive the products to be dispensed.

The attachment of the shelf divider to the gondola type store fixture is provided by slide means, which include a pair of slides secured to the bottom wall of the product shelf, and preferably immediately inward of its opposed side edges. These slides may be attached to either a shelf of the store fixture, or to forwardly extending brackets which in turn are connected to the uprights of the store fixture. Hence, the shelf assembly, including the individual slide means secured thereto and products secured therein, may be moved between a retracted position, which will generally overly the shelf area of the store fixture, or a forwardly extended position. In the forwardly extended position, the entire product shelf area of the organizer will be readily accessible to conveniently permit the restocking of products therein. After the restocking is completed, the shelf organizer is moved rearward, along its slide means to its retracted position. A detent is preferably provided to maintain the shelf organizer in the retracted position, so that it does not inadvertently move forward during its intended use for product presentation and selection.

Each of the shelf dividers will also advantageously include a spring biased pusher bar for urging successively arrayed products within the individual compartments towards the front surface. Thus, irrespective of how many individual products are within a compartment, the forward most one of such products will also be presented along the forward surface of the shelf organizer, with the removal of a product, automatically moving the next product forward.

To facilitate stocking of the storage display, the spring biased pusher bar may include a releasable means for retaining its pusher bar in the retracted position during product loading.

The releasable securement of this shelf divider to the product shelf portion of my shelf organizer is preferably provided by three readily defeatable connecting means at either ends of the shelf divider, and along its bottom edge. The biasing of the pusher bar may be provided by a negator spring which has its free end secured to the shelf divider side walls adjacent its forward or proximate end, with the remainder of the spiral spring being position behind the pusher bar frontal wall such that the spiral unwinds as the pusher bar is moved rewardly, with the force of the spring tending to wind the spiral, and thereby biasing the pusher bar towards the front surface.

According to one of the embodiments of our shelf organizer, the shelf dividers are preferably formed of metal, such as steel, which may be in the order of 1/16 of an inch thick. Hence, such a divider will provide the requisite rigidity and proper functioning while occupying minimal area within the product shelf. Hence, there will be maximum utilization of available space.

According to an alternative embodiment, the individual shelf dividers may be molded of plastic while including the same general features as in the aforementioned described embodiment. That is, it includes a similar negator spring biased pusher bar, and will be releasably located within the product shelf by connecting means associated with its front rear and bottom edges so as to secureably, while adjustably, mounting the shelf dividers within the product shelf to effectively accommodate the width of the particular products to be dispensed in each of the compartments.

By virtue of the adjustability of the shelf dividers, it is to be understood that all of the compartments need not be the same width. Thus, in addition to permitting adjustment of the compartments to accommodate different sized products, a single shelf organizer may be varied over its surface to effectively and attractively dispense a variety of products having different widths.

Accordingly, the primary object of the present invention is to provide an adjustable shelf organizer for dispensing a plurality of individual products, which readily permits product accessibility for loading, dispensing and restocking.

A further object of the present invention is to provide such a shelf organizer in which a product shelf which includes individually adjustable shelf dividers is slidably mounted to a gondola type store fixture.

Another object of the present invention is to provide such a shelf organizer in which each of the shelf dividers establishing the individual compartments includes a spring biased pusher bar for automatically moving the next product within each compartment to the forward dispensing position.

Yet another object of the present invention is to provide such a shelf organizer which is detent maintained within the dispensing position, but may be readily extended outward for ease of product restocking.

Yet another object of the present invention is to provide such a shelf organizer wherein each of the shelf dividers is releasably and frictionally retained within the unit by a plurality of connecting means at their front, rear, and along their bottom edges.

Still a further object of the present invention is to provide such a shelf organizer which permits different width compartments to be adjustably established within a single unit, so as to accommodate and conveniently dispense different products within a single shelf organizer.

These and other objects of the present invention will become readily apparent upon a consideration of the following drawings and descriptions.

BRIEF DESCRIPTION OF DRAWINGS

FIGS. 20 and 21 are cross-sectional views showing the manner in which a manually actuated detent means may be utilized to retain the shelf organizer in its retracted position, and released for subsequent movement to its extended position.

DETAILED DESCRIPTION

Figure 1:
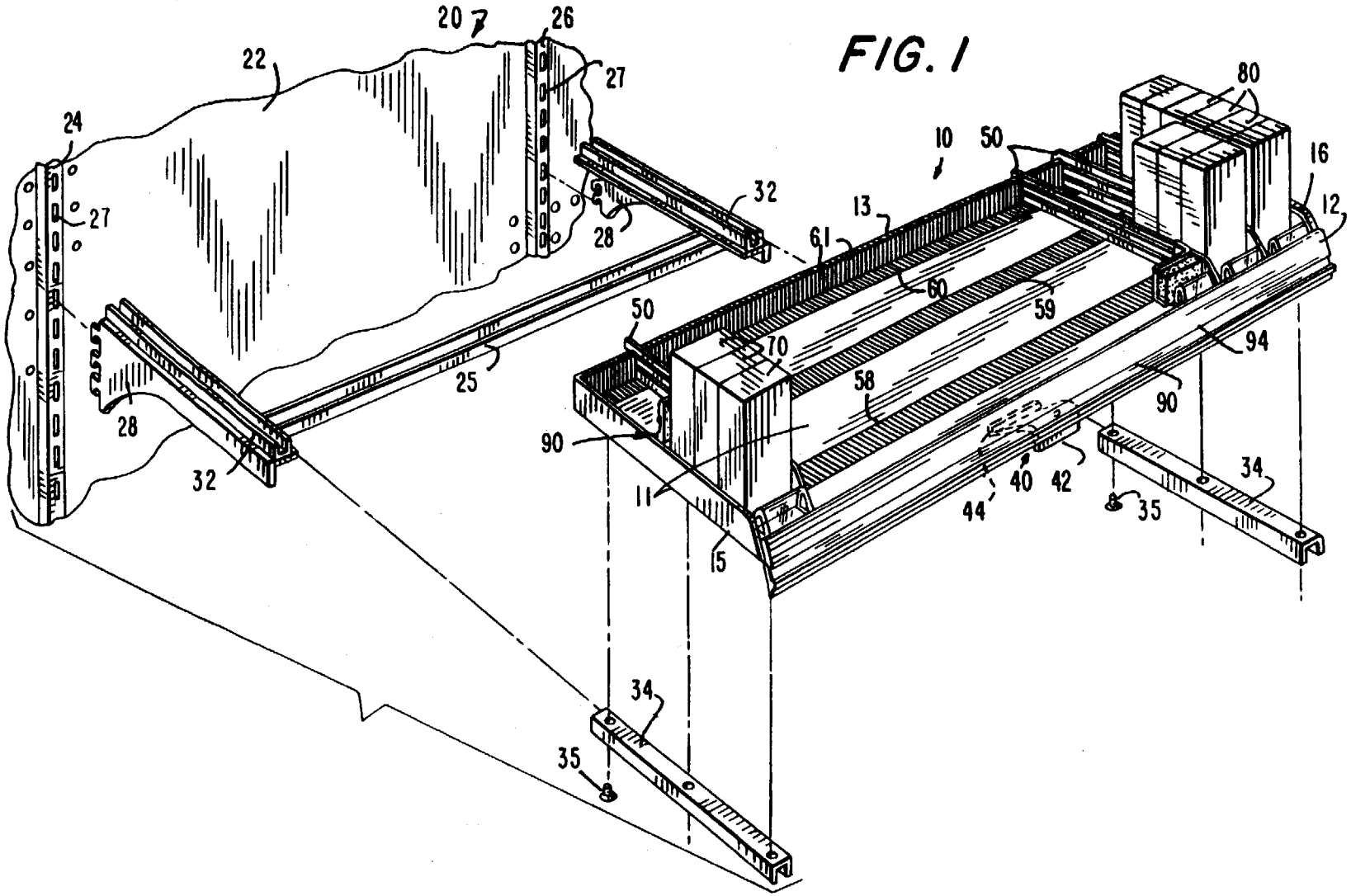
FIG. 1 is an exploded perspective view of a first embodiment of the present invention.
Figure 2:
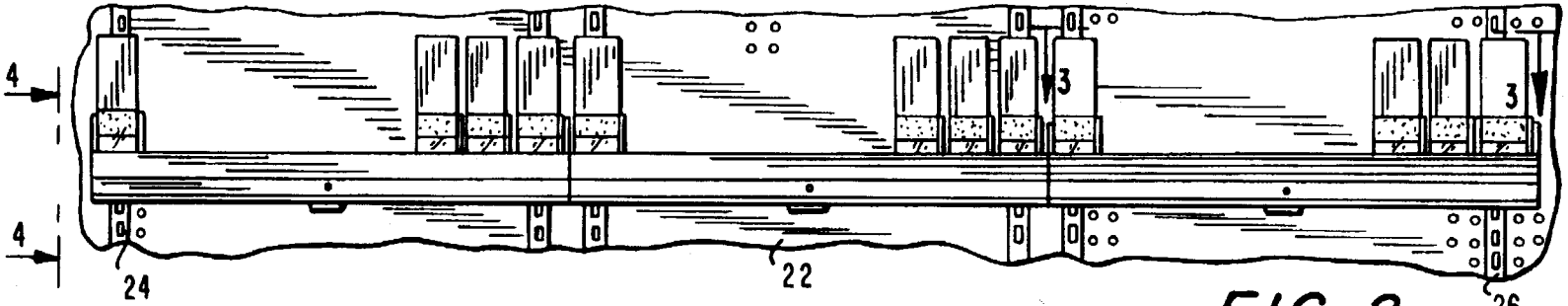
FIG. 2 is a front elevational view of one of the shelf organizers in the retracted, product dispensing position, but showing an array of products differing from FIG. 1.

Reference is initially made to the embodiment the invention shown in FIGS. 1–10. The shelf organizer, generally shown as 10, is intended to be located within a desired location of a gondola type of fixture 20, typically utilized in supermarkets, mass merchandisers, pharmacies or other retail establishments for the display and dispensing of individual products. The gondola 20, only a portion of which is shown in FIG. 1, typically includes a rear wall 22, onto which a pair of horizontally extending uprights 24–26 are attached in the well known manner. Uprights 24, 26 include a successive series of generally rectangular apertures 27 for the reception of vertically aligned standards 28. The standards 28 will be preselectively positioned in the appropriate openings 27 of the uprights 26 in order to provide a desired horizontal spacing between successive shelves or shelf organizers 10, with such spacing being dependent upon the anticipated height of the products being dispensed thereon, and overall aesthetic uniformity at the retail establishment. Advantageously, a cross bar 25 connects the pair of standards 28 intended to receive the shelf organizer 10.

The shelf organizer 10 is advantageously connected to the standards 28 by a slide means 30, including cooperating channels 32 and 34. Channels 32 are appropriately secured to the standards 28 as by screw means (not shown). Cooperating channel 34 is secured to the bottom edge 11 of the shelf organizer by screw means 35. As an alternative to securing the shelf organizer 10 directly to the standards 28, a fixture shelf may be interposed between the standards and shelf organizer, as is shown in the subsequently discussed embodiment of FIGS. 11–24.

Figure 4:
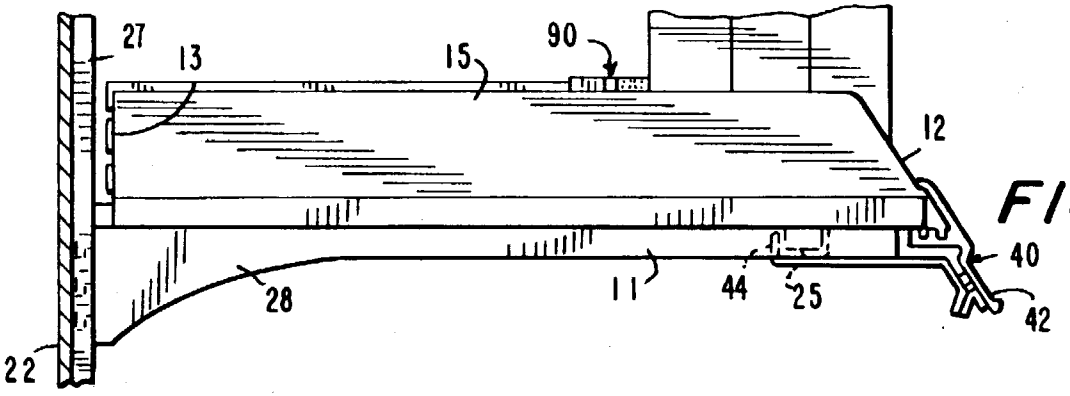
FIG. 4 is a side elevational view as shown by the arrows 4—4 of FIG. 2, and looking in the direction of the arrows.
Figure 5:
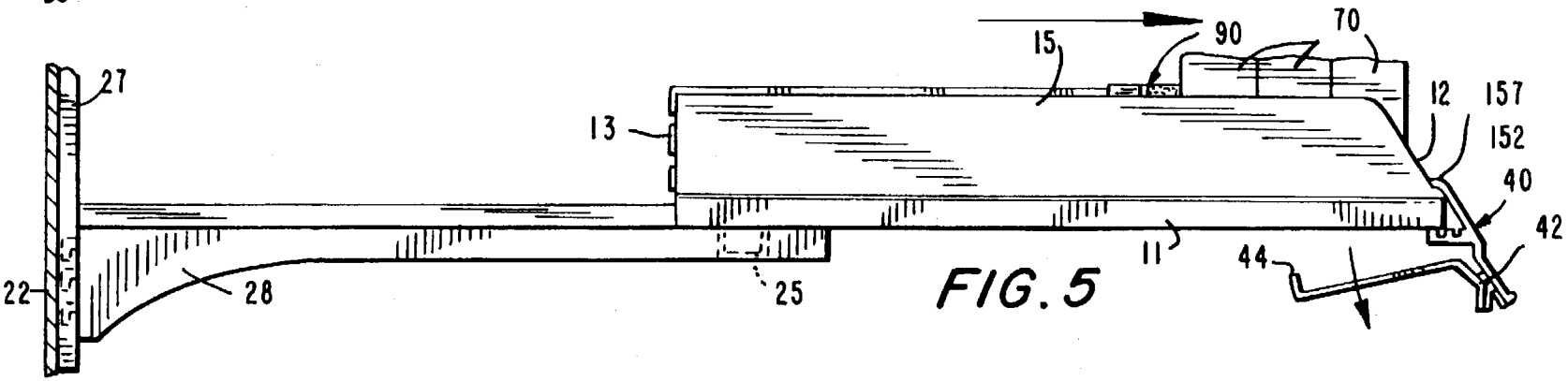
FIG. 5 is a view corresponding to FIG. 4, but with the shelf organizer extended outward along the side means for product restocking.
Figure 3:
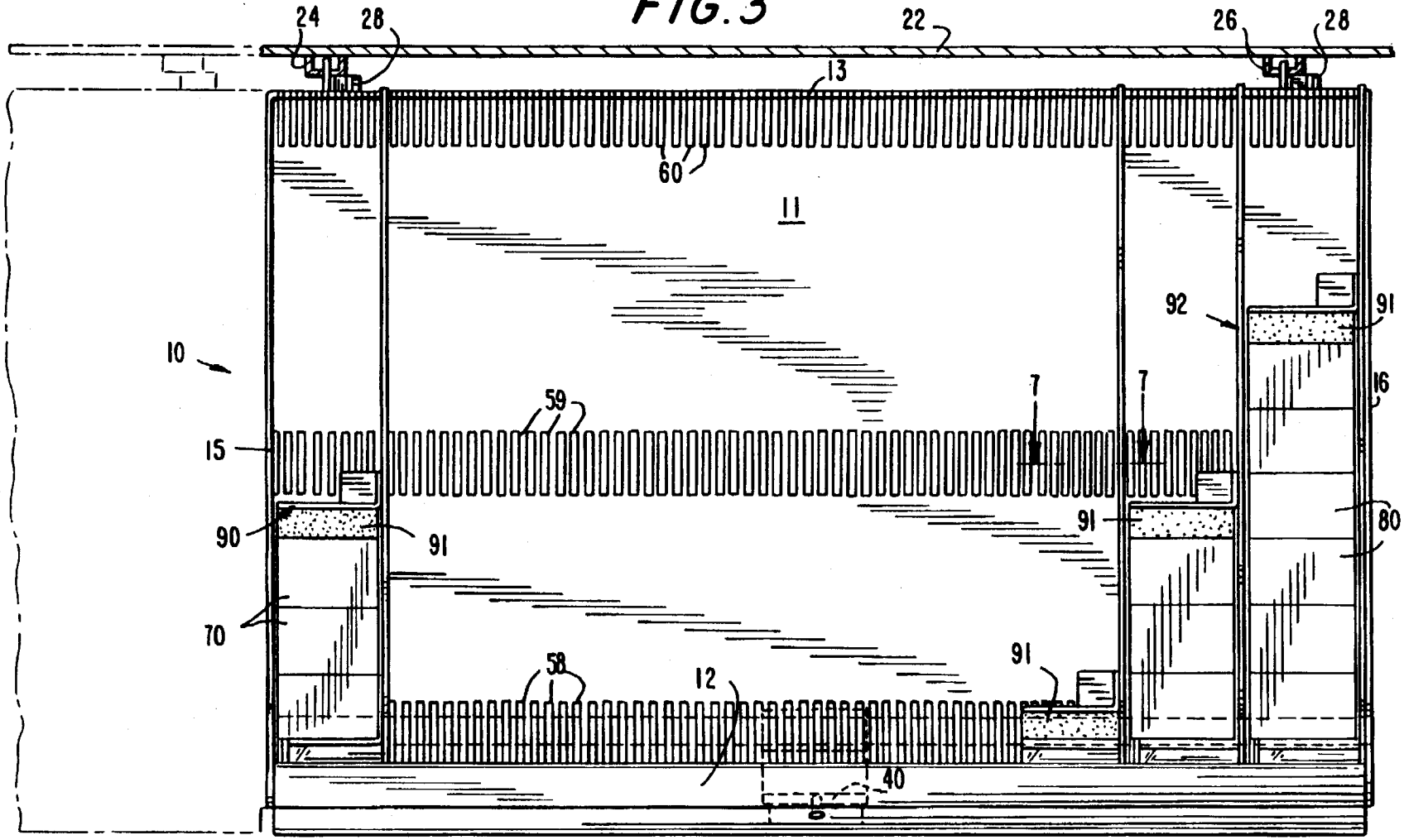
FIG. 3 is top view corresponding to FIG. 1, with the shelf organizer being in the retracted, product dispensing position.

Shelf organizer 10 includes a product shelf bounded by bottom wall 11, front edge 13, rear edge 14 and opposed side edges 15, 16. Advantageously, a detent means 40 is mounted to the frontal bottom wall 11, preferably at its center. Detent means 40 includes a manually actuable portion 42 and a locking portion of 44. Locking portion 44 is adapted to engage the underside of cross-bar 25, as shown in FIG. 4, so as to maintain the product shelf 10 in its retracted position. Counterclockwise movement of manually actuable portion 42 (as shown in FIGS. 4 and 5) will release the engagement between locking portion 44 and crossbar 25, enabling the shelf organizer to be moved to the extended position, as shown in FIG. 5. As will subsequently be discussed, such extended position provides access to the entire product receiving area of the shelf organizer 10, so as to facilitate product restocking.

Figure 6:
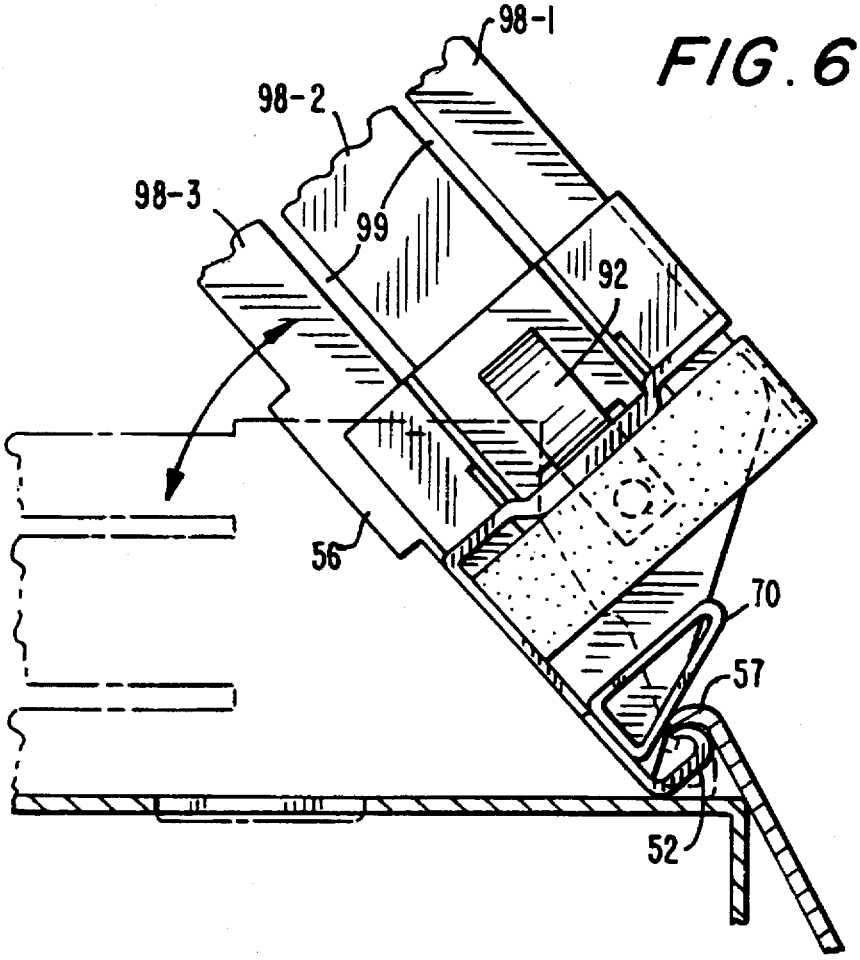
FIG. 6 is a side elevational view of the forward portion of one of the adjustable shelf dividers, and showing the manner in which it is selectively installed onto the product shelf of the shelf organizer.

The product shelf organizer 10 is divided into individual compartments by a series of identical shelf dividers 50. Each of the shelf dividers includes a first connecting means 52 at its front, or proximate, end, a second connecting means 54 at its rear, or distal end and a third connecting means 56 along its bottom edge (See FIG. 8). Third connecting means 56 is shown as a series of spaced tabs depending downward from the bottom edge. The first connecting means 52 is in the form of a bulbous curved portion which is shaped to be pivoted into a complimentary channel 57 along the front edge 12, the product shelf, as best shown in FIG. 6. Extending along the bottom and rear walls of the product shelf are series of aligned spaced slots 58, 59, 60, and 61. The lengths of ajacent slots may be staggered to facilitate vertical alignment during the insertion of shelf divider 50. In order to insert the shelf divider 50 at its desired location, as the first connecting means 52–57 are brought into pivotal engagement, the second connection means 54 at the distal end of the shelf divider is location within the desired slot 61, with tabs 56 then being aligned in slots 58, 59 and 60. Hence, the individual shelf dividers 50 may be readily and adjustably inserted to provide a desired series of product compartments between the side edges 15, 16 of the product shelf.

As shown in FIGS. 1, three shelf dividers are illustratively shown, with it being understood that in actual practice, the central portion of the product shelf, shown devoid of shelf dividers and products, will likewise contain same. The shelf divider 50 closest to side edge 15 is appropriately positioned so as to closely correspond to the width of products 70 being dispensed in the compartment defined between that shelf divider and side wall 15. Similarly, the shelf divider 50 closest to the opposite side edge 16 will be appropriately positioned to suitably accommodate packages 80. Packages 70 and 80 are shown to be of the same width. However, it should readily be appreciated that the spacing of shelf dividers 50 can be suitably varied if it is desired to dispense products of different widths from a single shelf organizer 10. Similarly, where several shelf organizers are to be provided within a single gondola fixture, each may be configured to dispense different products. It should be further appreciated that a shelf divider 10 which has been configured to dispense a particular product (e.g. 80) may be subsequently modified to dispense a different product, as by readjusting the location of the individual shelf dividers 50 in accordance with the subsequent products to be dispensed.

Figure 7:
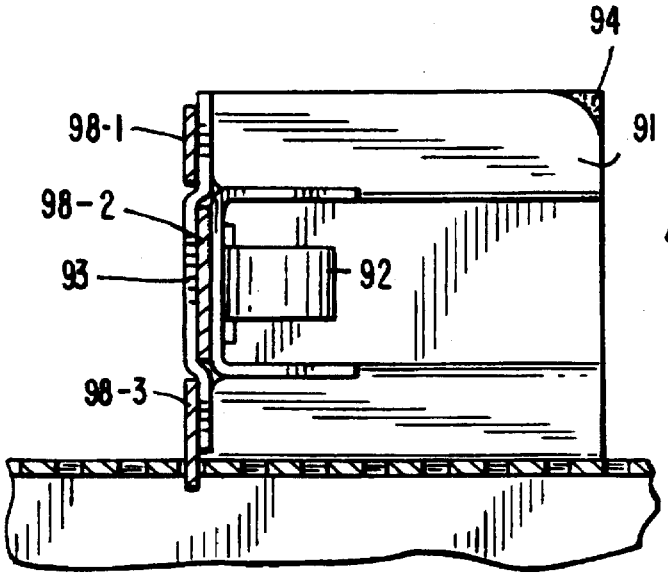
FIG. 7 is a cross-sectional view as shown by the arrow 7—7 of FIG. 3, showing further details of the pusher bar portion of the shelf divider.
Figure 9:
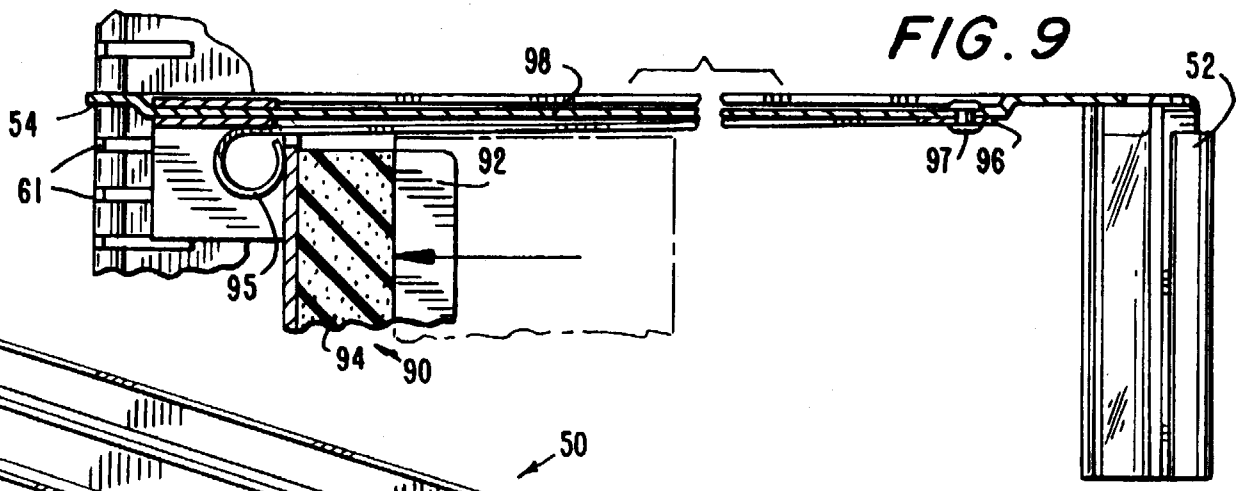
FIG. 9 is a top cross-sectional view of the shelf divider, with the pusher bar being moved rearward from the position shown in FIG. 8.
Figure 8:
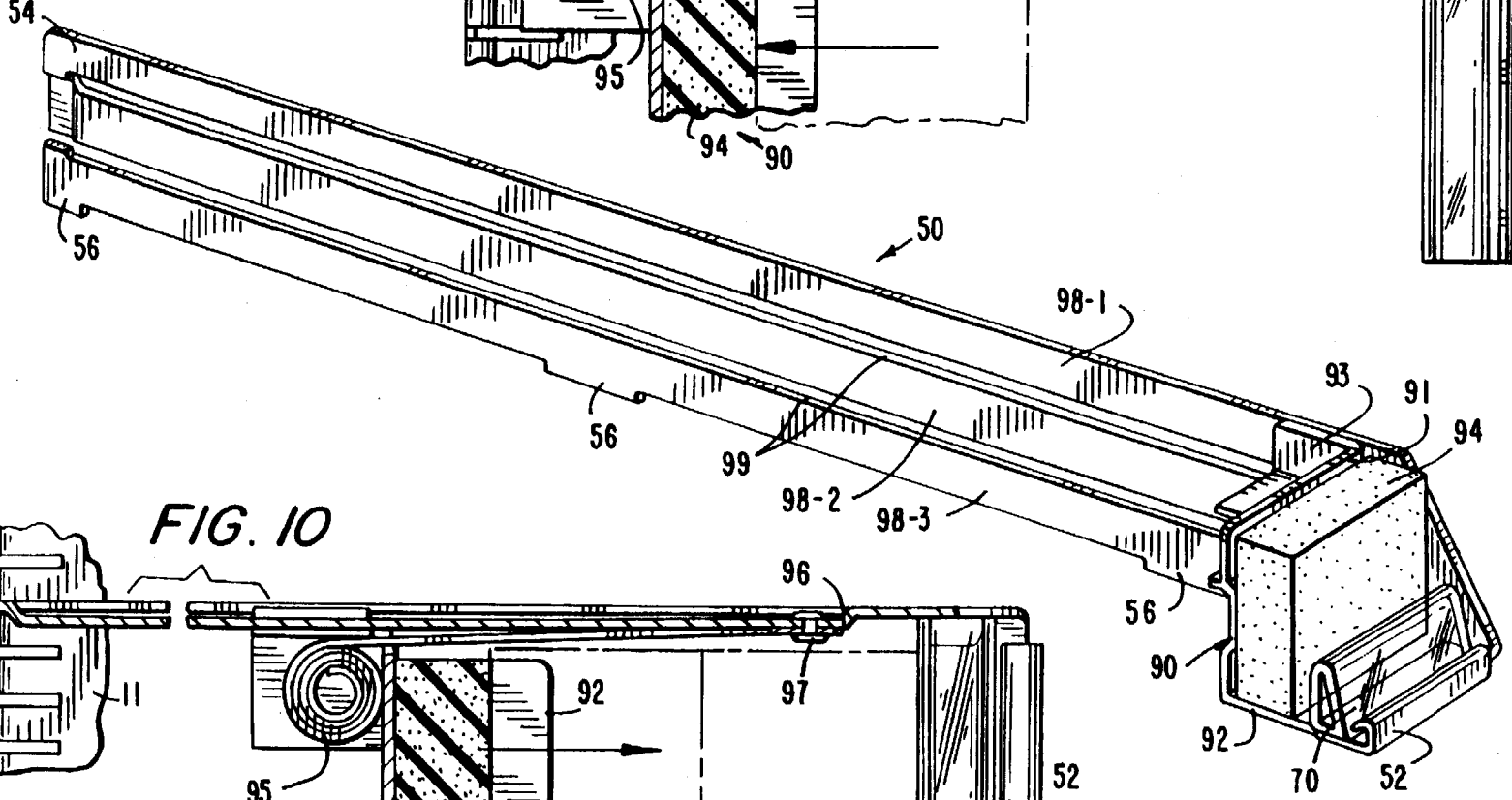
FIG. 8 is a perspective view of the shelf divider incorporated in this first embodiment, the present invention.
Figure 10:
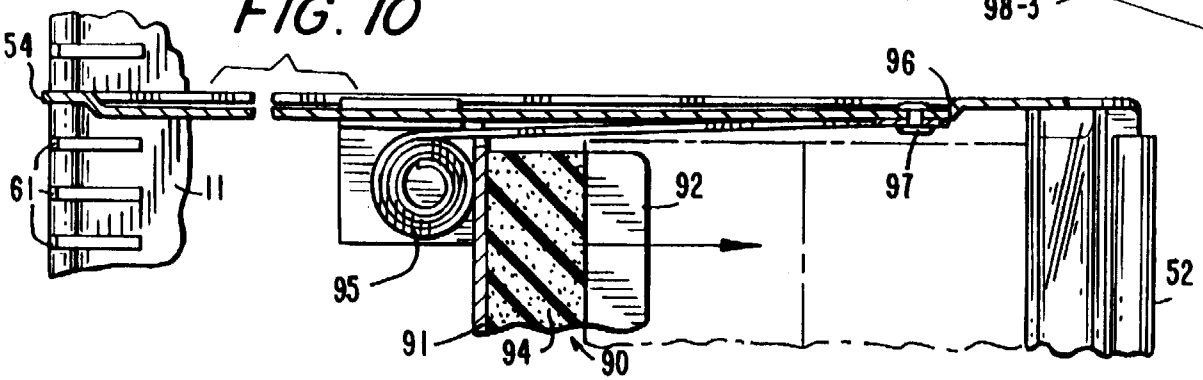
FIG. 10 is a cross-sectional view, generally corresponding to FIG. 9, but showing further details of the connection of the pusher bar spring biasing means to the side wall of the shelf divider.
Figure 11:
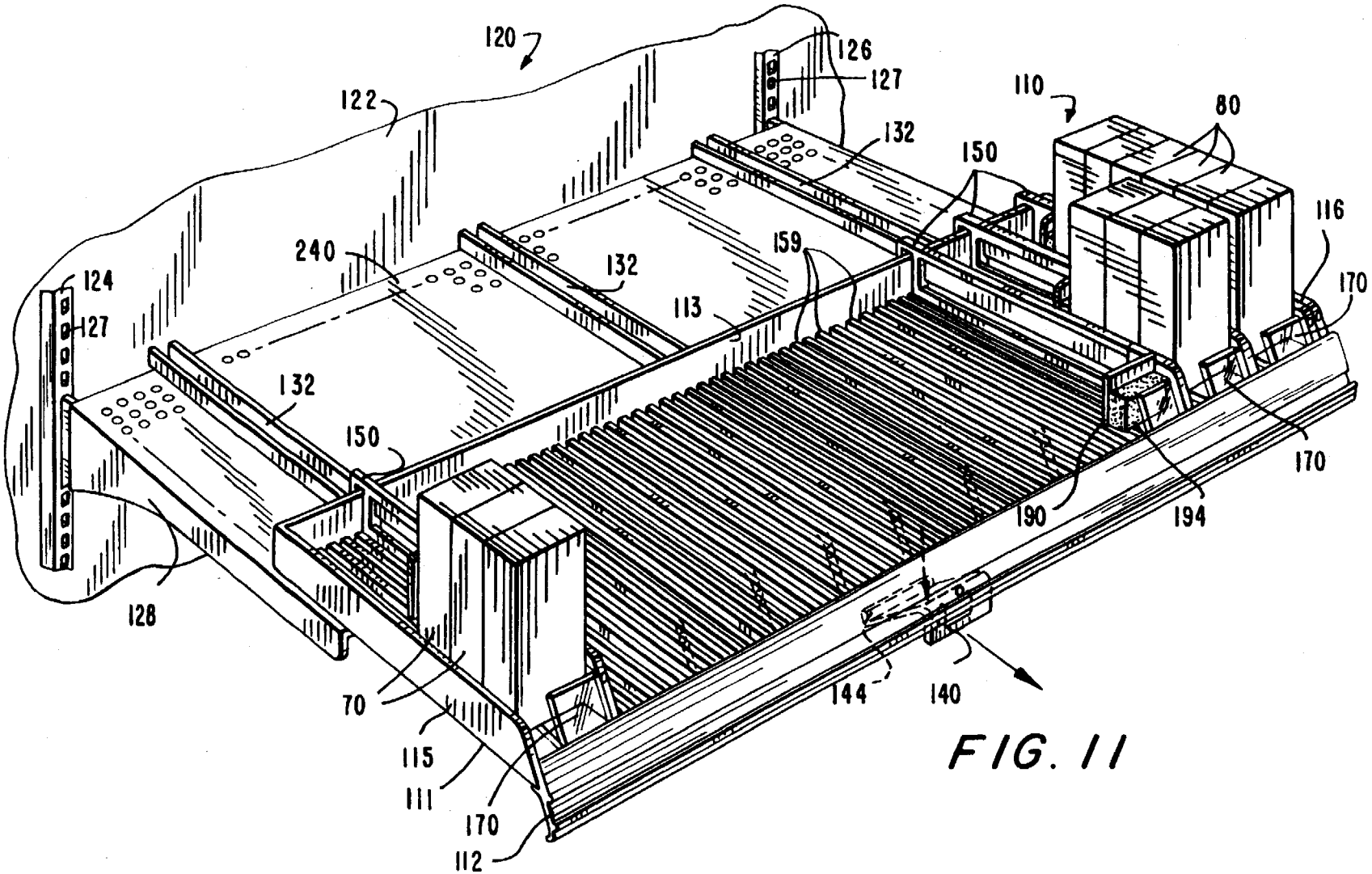
FIG. 11 is a perspective view of an alternative embodiment of the present invention.
Figure 12:
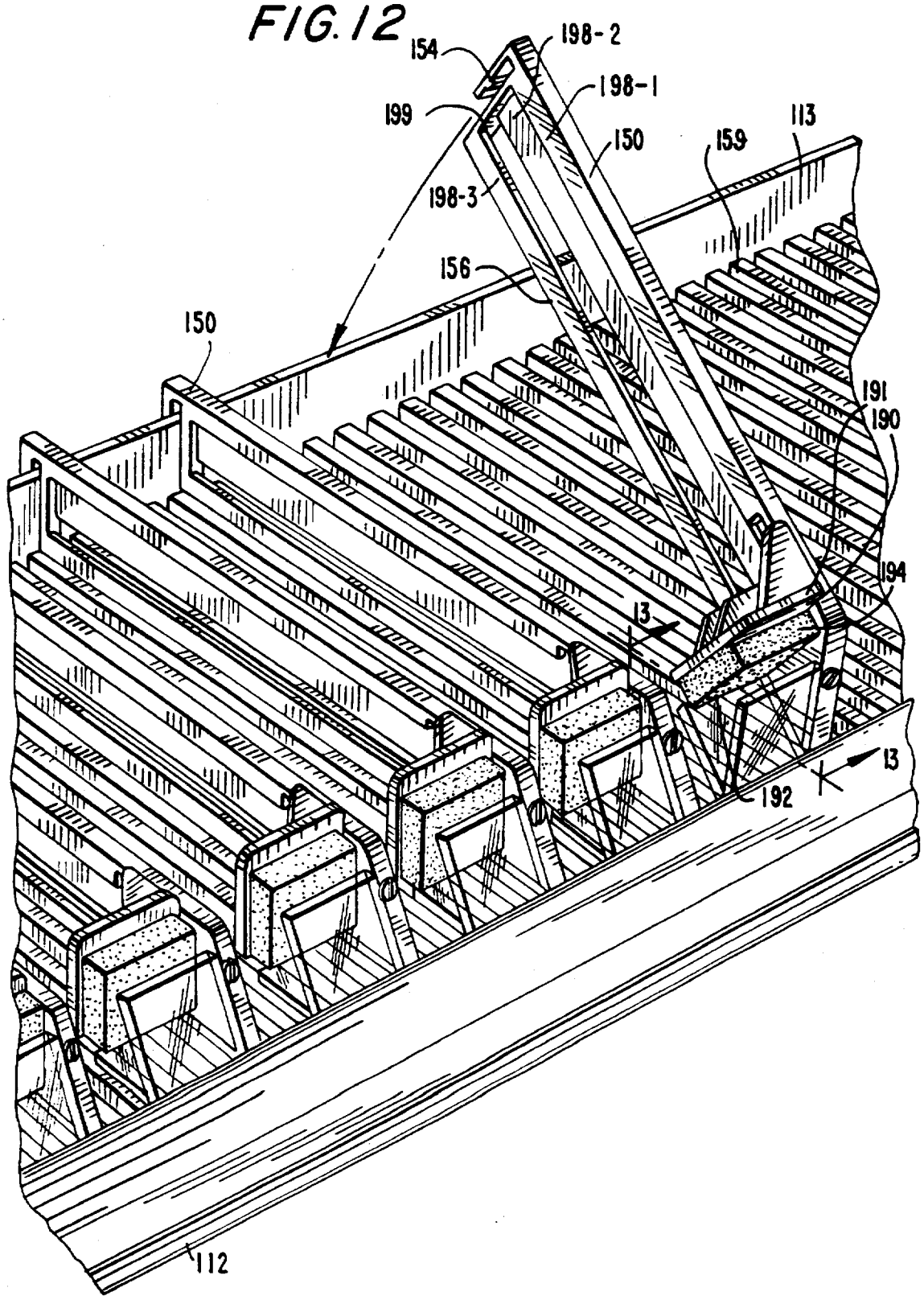
FIG. 12 is a perspective view of a portion of the shelf organizer of FIG. 12, and showing the manner in which the shelf divider is installed within the product shelf.
Figure 13:
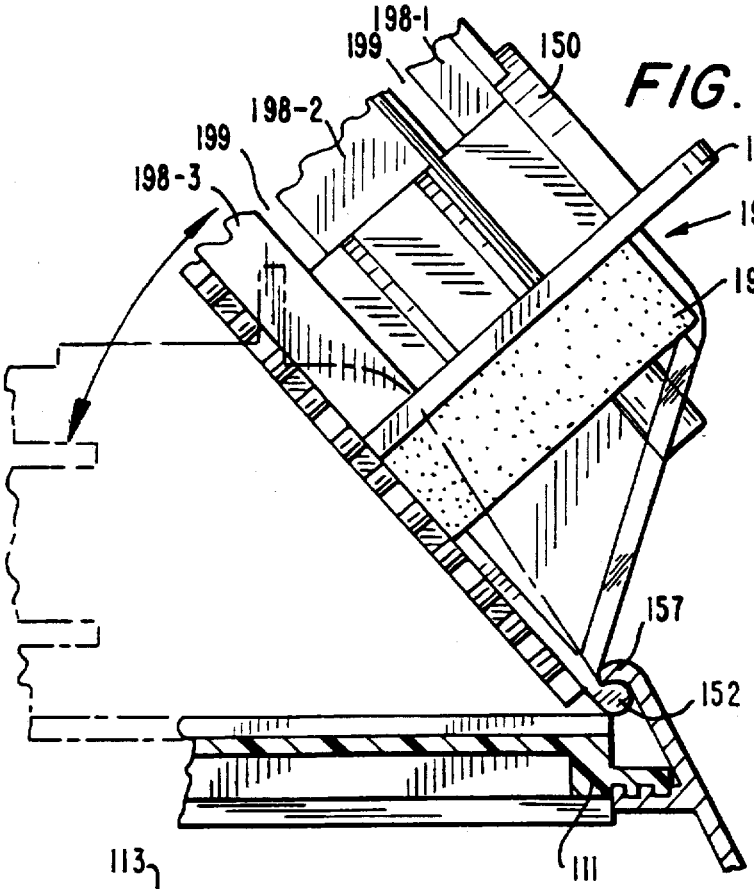
FIG. 13 is a cross-sectional view as shown by the arrows 13—13 in FIG. 12 and looking in the direction thereof.
Figure 14:
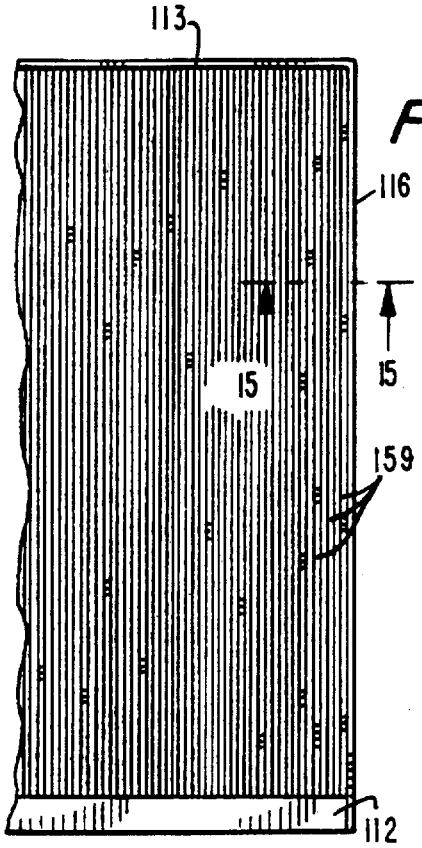
FIG. 14 is a top view of a portion of the product shelf.
Figure 15:
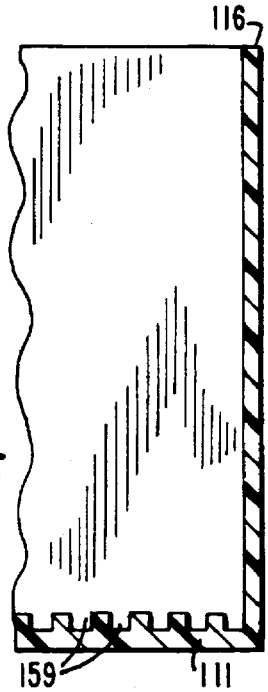
FIG. 15 is a cross-sectional view as shown by the arrows 15—15 of FIG. 14, and looking in the direction thereof.

In order to provide for successive presentation of the next to be dispensed product 80 along the forward edge 12 of the product shelf, a pusher bar assembly 90 translates along the slider bar. The pusher bar assembly includes a vertical wall surface 91 and bottom wall surface 92 and side wall 93. Side wall has an Undulated cross-section (as best shown in FIG. 7) which is adapted to be guided within tracks defined by successively spaced surfaces of sections 98-1, 98-2 and 98-3 of the shelf divider side wall. Side wall sections 98-1, 98-2 and 98-3 are separated by elongated channels 99, which provide a path for the guided movement of the pusher bar 90 between the proximate and distal ends of the shelf divider. The proximate end of the shelf divider should also include a product stop member 70 which is preferably transparent, so as not to detract from product presentation.

The pusher bar 90 will be biased towards the proximate end of the shelf divider 50 by a spiral negator spring having its free end 96 secured to the shelf divider side wall 98, as by rivet fastener 97. The spiral portion of the negator spring 95 is positioned behind vertical wall 91, so as to urge same towards the proximate end of the shelf divider. The pusher bar preferably includes a cushioning member 94, which may be foam sponge, at its frontal surface, for engagement with the rear most product package (70 or 80) being dispensed. The sponge member 94 advantageously permits the pusher bar assembly 90 to readily adapt itself to different product configurations. It should thus be appreciated that the products in each of the compartments will be continually urged forward by the biasing force of its respective spring 95. When the customer removes the front most package, the next successive package is automatically moved forward to the position previously occupied by the package that has been removed.

In order to maximize the space available for product storage within the shelf organizer, the shelf divider should be of minimal width. In accordance with the embodiment shown in FIGS. 1–10, the shelf dividers, as well as the pusher bar assembly, may all be constructed of steel, having a width of approximately 1/16 of an inch. Each shelf divider may be in the order of 14 inches long, and have a height of approximately two inches. It should be readily be understood, however, that these dimensions are provided for illustrative purposes only, and the present invention will readily accommodate other sizes. The product shelf may also be formed of steel of an appropriate thickness to provide the requisite structural integrity of the assembly 10.

Reference is now made to FIGS. 11–24 which shows an alternative embodiment of the present invention, and in which components corresponding to that shown in embodiment of FIGS. 1–11 are similarly designated, but with the 1 prefix. Whereas the embodiment of FIGS. 1–10 formed the shelf organizer of metal,the unit of FIGS. 11–24 is intended to be molded of plastic material. The product shelf portion of shelf organizer 110 is molded as a single unit including bottom wall 111, front wall 112, rear wall 113 and oppose side walls 115, 116. The bottom wall 111 includes a successive series of horizontally spaced and vertically aligned channels 159 which extend between the forward 112 and rear 113 walls thereof. Each of the shelf dividers 150, which is similarly molded of plastic, includes the bulbous extension 152, which is inserted within channel 157 along the front wall 111, as the shelf divider 150 is pivoted, with its narrowed bottom edge extension 156 entering the selected channel 159, as its rear end connector 154 frictionally engages the rear wall 113. Hence, the channels 159 along the bottom wall 111 dividers the individual locations for the shelf dividers 150 for forming product containing compartments of desired widths.

Each shelf assembly 150 includes a pusher bar 190 which generally corresponds in structure and function to the pusher bar 90 of the prior embodiment, and is similarly biased towards the proximate end of the shelf divider by spiral negator spring 195.

Figure 16:
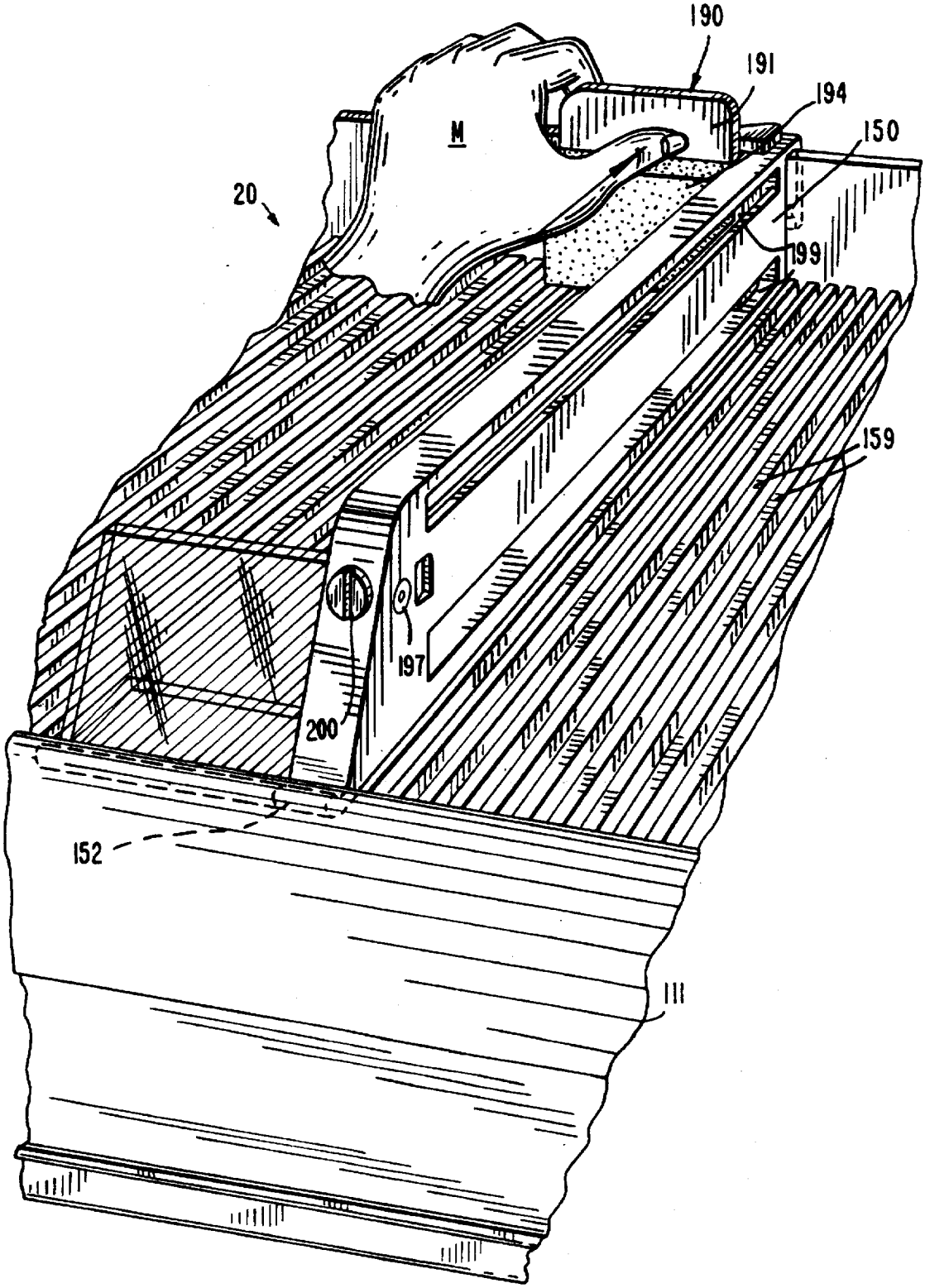
FIG. 16 is a perspective view showing the manner in which the pusher bar is manually moved to its extreme rearward position for product loading.
Figure 18:
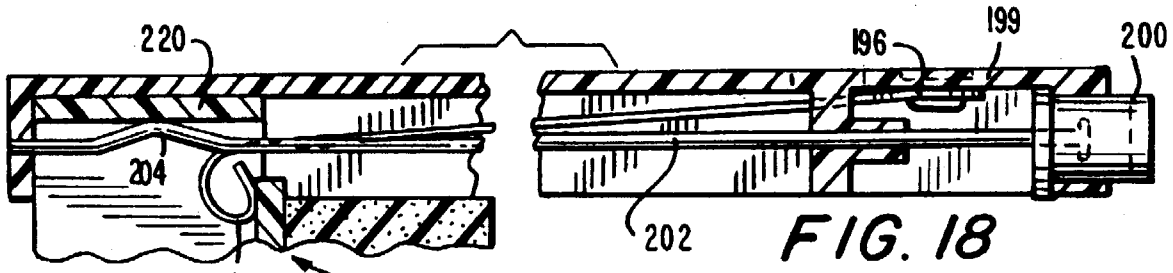
FIG. 18 is a cross-sectional top view of the shelf divider, with the pusher bar in the position shown in FIG. 16.
Figure 17:
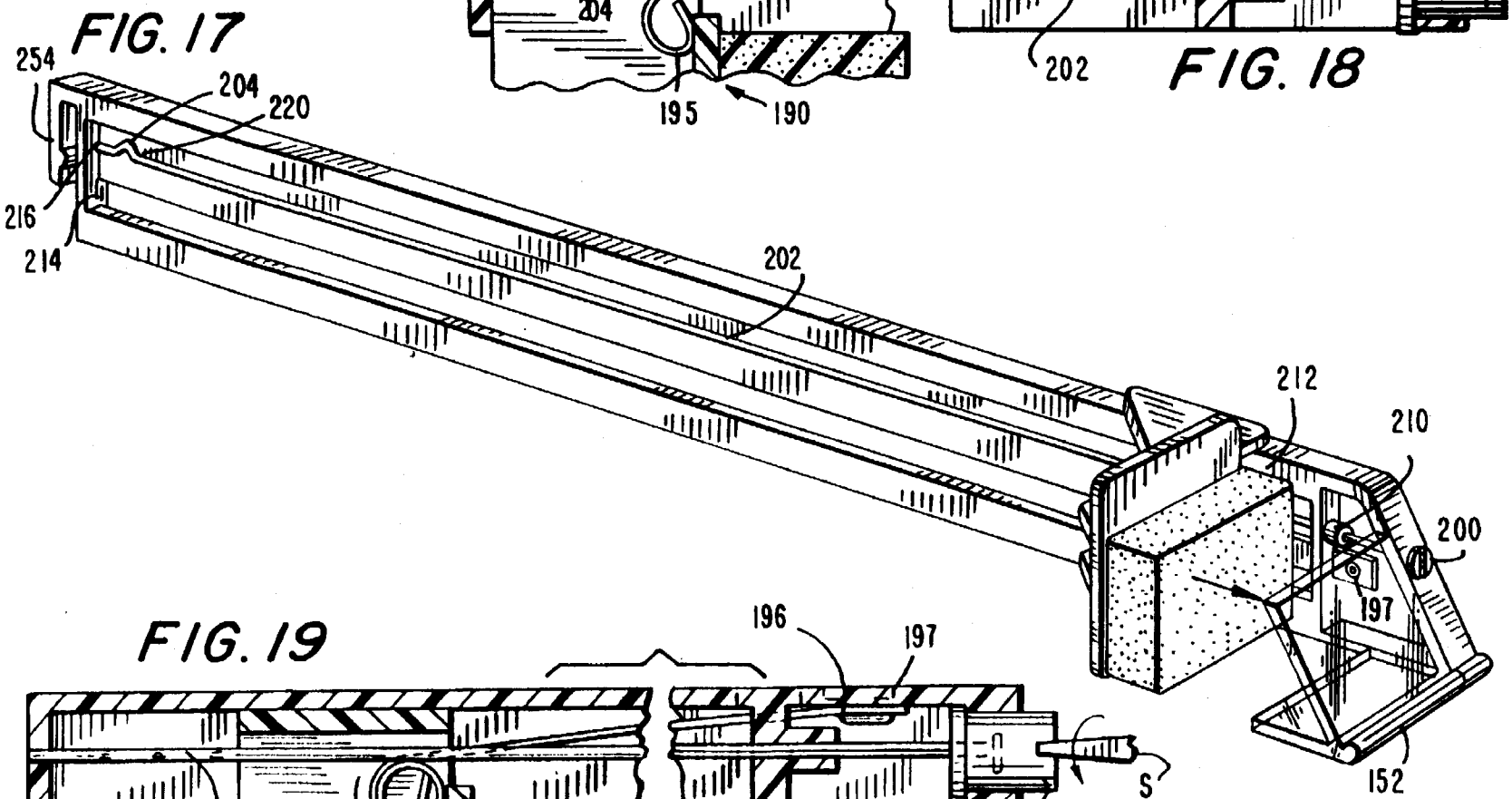
FIG. 17 is a perspective view of the shelf divider of the this alternative embodiment.
Figure 19:
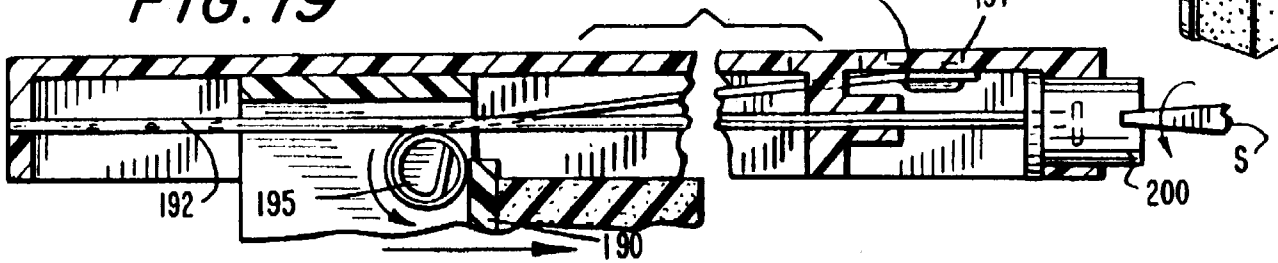
FIG. 19 is a cross-sectional view corresponding to FIG. 18, but with a manual activated retaining means being moved into position to retain the pusher bar in its retracted condition to facilitate product loading.
Figure 22:
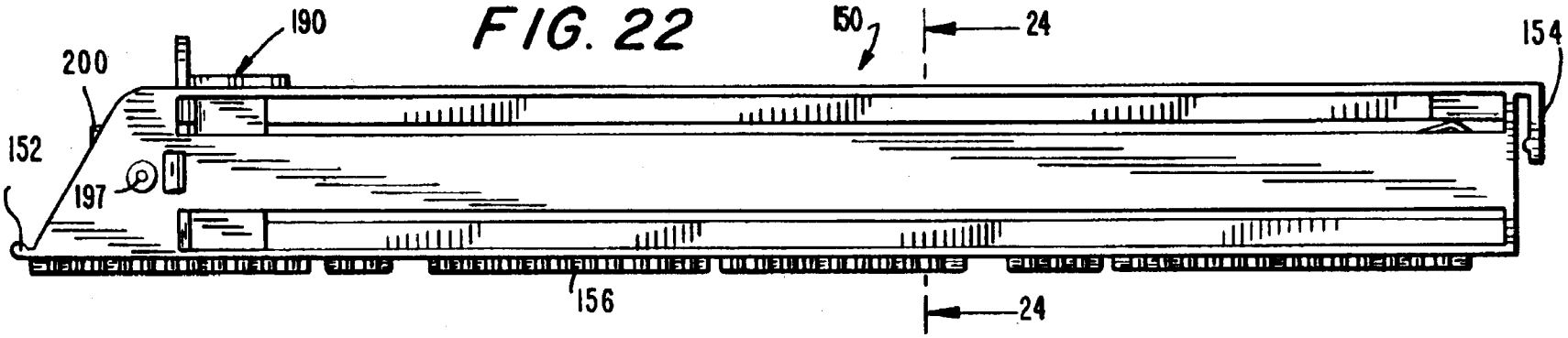
FIGS. 22 and 23 are side elevational and top views of the shelf divider shown in FIG. 17.
Figure 23:
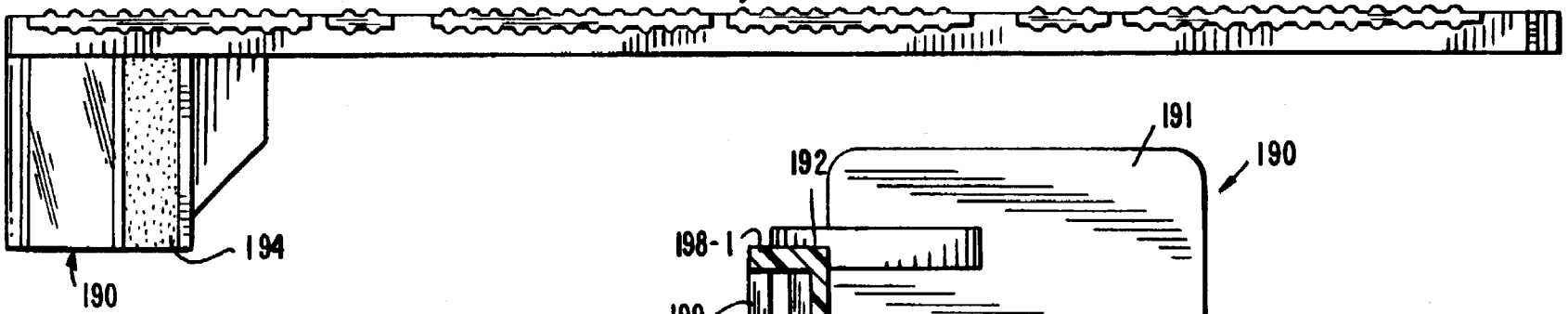
Figure 24:
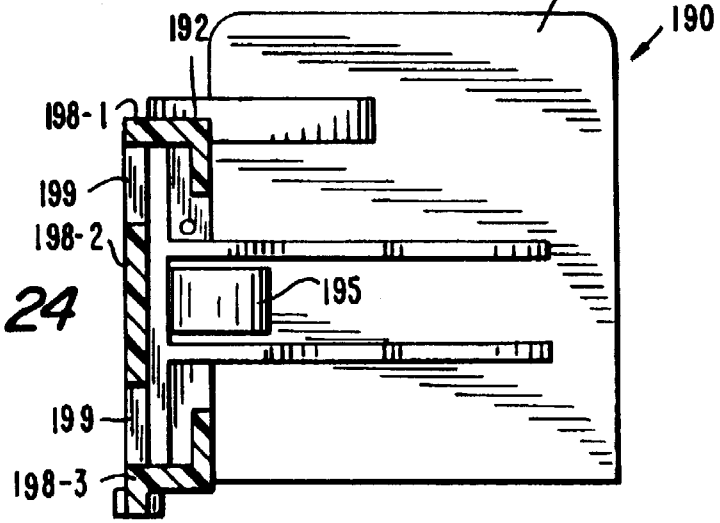
FIG. 24 is a cross-sectional view as shown by the arrows 24—24 of FIG. 22 and looking the direction thereof.

A pusher bar retaining means, the details of which are best shown in FIG. 16–19, is also provided to advantageously maintain the pusher bar assembly 190, in the retracted position during product loading. As shown in FIG. 16, the individual desiring to reload shelf organizer to 10 would first place his or her hand M against surface 191 of the pusher bar 190 moving same to the fully retracted position shown in FIG. 16. A screwdriver S is then inserted within screwhead 200 so as to rotate elongated wire member 192 approximately 90° from the condition shown in FIG. 17, to that shown in FIG. 18.

Elongated wire member 192 is supported at one end thereof by bushing extension 210 of wall member 212, and at its opposite end by wall member 216. Elongated wire 202 includes a triangular offset section 204 which, when wire 202 is rotated, will frictionally engage wall 220 of the pusher bar assembly 190. This frictional engagement will be of sufficient strength to counteract the biasing force of negator spring 195, so as to maintain the pusher bar 190 in its retracted position during product reloading. When the reloading is completed, a screwdriver is then reinserted within screwhead 200, which is rotated back 90° to release the engagement between portion 204 of the pusher bar retainer and wall 220, thereby permitting the pusher bar assembly 190 to move forward and engage the rear most product present in the particular compartment.

In this particular embodiment, the shelf organizer 210, rather than being directly, connected to standards 128 (as shown in the embodiment of FIGS. 1–11) is slide mounted to a horizontal shelf 240, which in turn is connected via standards 128 to the uprights 124, 126 of the store fixture. Hence, the locking portion 144 of detent mechanism 140 will engage shelf 240 when the shelf organizer 210 is in the retracted position. To move the shelf organizer 210 to its extended position for product loading, the detent will be manually defeated, as shown in FIG. 20 by suitable rotation of manually portion 142. After product loading, the shelf organizer 110 is then slid rearward, with detent 140 automatically retaining the shelf organizer in its product dispensing position.

Accordingly, it should be appreciated that while preferred embodiments of the present invention have been described in detail, various modifications, alterations and changes may be made without departing from the spirit and scope of the present invention as defined in the following claims.

What is claimed:

1. A shelf organizer for the storage and dispensing a plurality of individual products, comprising a product shelf including a bottom wall, front, rear and opposed side edges;

slide means secured to said bottom wall for the slidable mounting of said product shelf to a retail display fixture, such that said product shelf has an extended and retractable position with respect to the retail display fixture;

each of said front and rear edges including an upstanding wall to provide front and rear walls;

a plurality of identical shelf dividers each having a proximate end, distal end, side walls and a bottom edge, said shelf dividers selectively positioned between said product shelf opposed side edges to form a plurality of successive compartments between said opposed side edges, with each of said dividers extending between said front and rear walls;

each of said shelf dividers including first connecting means at its proximate end, second connecting means at its distal end and third connecting means at its bottom edge;

said front wall including first mounting means for releasably receiving said first connecting means at a desired location along its extent, between said opposed side edges;

said rear wall including second mounting means for releasably receiving said second connecting means of a desired location along its extent between said opposed side edges;

said bottom wall including a plurality of third mounting means, spaced along its extent between said opposed side edges, adapted to releasably receiving said third connecting means; and each of said plurality of shelf dividers mounted to selected aligned ones of said first, second and third mounting means for securably and adjustably mounting said shelf dividers at preselected desired ones of said mounting means, with such preselection establishing a plurality of product receiving compartments of a predetermined width between successive shelf dividers, the width of each compartment determined by the selected one of the mounting means receiving the respective connecting means.

2. A shelf organizer according to claim 1, wherein:

each of said receiving and connecting means provides for snap-in type of engagement, for securably mounting each of said shelf dividers to said product shelf at its proximate end, distal end and bottom edge.

3. A shelf organizer according to claim 1 wherein:

each of said shelf dividers includes a retractable spring biased pusher bar for urging successively arrayed products within its respective compartment towards said front surface.

4. A shelf organizer according to claim 3 wherein:

further including releasable means for retaining said pusher bar in its retracted position during product loading.

5. A shelf organizer according to claim 2, wherein each of said shelf dividers includes a retractable spring biased pusher bar for urging successively arrayed products within its respective compartment towards said front surface.

6. A shelf organizer according to claim 1, wherein:

said first connecting means is a bulbous projection along said proximate end and said first mounting means is a resilient channel along said front wall for frictionally retaining said first connecting means at an adjustable preselected location along said front wall.

7. A shelf organizer according to claim 1, wherein:

said second connecting means and second mounting means including cooperating elements for frictionally retaining said distal end of the shelf divider at an adjustable preselected location along said rear wall.

8. A shelf organizer according to claim 1, wherein:

said third mounting means includes a plurality of spaced recesses along said bottom wall, and said third connecting means including wall surfaces along the bottom of said shelf divider, to be positioned with the bottom wall recess at a preselected location, for securably and adjustably retaining said bottom edge in said bottom wall, with the proximate and distal ends of the shelf divider being connected to said front and rear walls.

9. A shelf organizer according to claim 8, wherein:

said first connecting means is a bulbous projection along said proximate end and said first mounting means is a resilient channel along said front wall for frictionally retaining said first connecting means at an adjustable preselected location along said front wall and, said second connecting means and second mounting means including cooperating elements for frictionally retaining said distal end of the shelf divider at an adjustable preselected location along said rear wall.

10. A shelf organizer according to claim 1, further including detent means for selectively retaining said shelf in its retracted position.

11. A shelf organizer according to claim 2, wherein:

said first connecting means is a bulbous projection along said proximate end and said first mounting means is a resilient channel along said front wall for frictionally retaining said first connecting means at an adjustable preselected location along said front wall;

said second connecting means and second mounting means including cooperating elements for frictionally retaining said distal end of the shelf divider at an adjustable preselected location along said rear wall, and said third mounting means includes a plurality of spaced recesses along said bottom wall, and said third connecting means including wall surfaces along the bottom of said shelf divider, to be positioned with the bottom wall recess at a preselected location, for securably and adjustably retaining said bottom edge in said bottom wall, with the proximate and distal ends of the shelf divider being connected to said front and rear walls.

12. A shelf organizer according to claim 3, wherein:

each of said shelf dividers including a track extending along its side wall, substantially between its proximate and distal ends; and said pusher bar including a frontal wall for engagement with the product being dispensed, and a side wall located within said track to controllably guide the travel of said pusher bar along said track.

13. A shelf organizer according to claim 12, wherein:

said frontal wall of said pusher bar includes a cushioning means.

14. A shelf organizer according to claim 12, wherein:

the spring biasing for said pusher bar is provided by a spiral negator spring, having a free end secured to said shelf divider side wall adjacent its proximate end, the spiral portion of said negator spring positioned behind said pusher bar frontal wall, such that said pusher bar is biased towards said front wall of the shelf unit, with the movement of said pusher bar towards the distal end of its shelf divider being opposed by said spring as its is uncoiled along said side wall of the shelf divider.

15. A shelf organizer according to claim 1, wherein:

the product receiving compartments may be of a plurality of different widths.

16. A shelf organizer according to claim 8, wherein:

said wall surfaces of said third connecting means including a plurality of spaced downwardly extending tabs, and the recesses of said third mounting means including a plurality of adjacent sets of recesses, each such set extending between said front and rear walls of said product shelf, with the spacing between the individual recesses in each set corresponding to the spacing between the individual tabs of said third connecting means, a plurality of such sets being successively spaced between the opposed side edges of said product shelf, whereby the selected engagement between said tabs and recesses establishes the width of the compartments between adjacent ones of said shelf dividers.

17. A shelf organizer according to claim 15, wherein:

each of said shelf dividers is formed of metal, and has a width in the order of one-sixteenth of an inch.

18. A product display comprising:

a fixture including a plurality of vertically spaced shelf locations, at least one of said shelf locations including a product shelf including a bottom wall, front, rear and opposed side edges;

slide means secured to said bottom wall for the slidable mounting of said product shelf to said shelf location such that said product shelf has an extended and retractable position with respect to said shelf location;

each of said front and rear edges including an upstanding wall to provide front and rear walls;

a plurality of identical shelf dividers each having a proximate end, distal end, side walls and a bottom edge, said shelf dividers selectively positioned between said product shelf opposed side edges to form a plurality of successive compartments between said opposed side edges, with each of said dividers extending between said front and rear walls;

each of said shelf dividers including first connecting means at its proximate end, second connecting means at its distal end and third connecting means at its bottom edge;

said front wall including first mounting means for releasably receiving said first connecting means at a desired location along its extent, between said opposed side edges;

said rear wall including second mounting means for releasably receiving said second connecting means of a desired location along its extent between said opposed side edges;

said bottom wall including a plurality of third connecting means, spaced along its extent between said opposed side edges, adopted to releasably receiving said third mounting means; and each of said plurality of shelf dividers, mounted to selected aligned ones of said first, second and third mounting means for securably and adjustably mounting said shelf dividers at preselected desired ones of said mounting means, which such preselection establishing a plurality of product receiving compartments of a predetermined width between successive shelf dividers, the width of each compartment determined by the selected one of the mounting means receiving the respective connecting means.

19. A product display according to claim 18, wherein:

said fixture further includes at least one pair of vertical uprights having a separation in the order of the separation between the opposed end walls of said shelf organizer and a plurality of vertically spaced mounting means;

bracket means for connection to selected vertically aligned pairs of the upright mounting means; and said slide means interconnected between said bracket means and bottom wall of said shelf assembly, for moving said shelf assembly between its extended and retracted positions relative to said vertical uprights.

20. A product display according to claim 19, wherein:

each of said receiving and connecting means provides for snap-in type of engagement, for securably mounting each of said shelf dividers to said product shelf at its proximate end, distal end and bottom edge;

each of said shelf dividers includes a retractable spring biased pusher bar for urging successively arrayed products within its respective compartment towards said front surface;

said third mounting means includes a plurality of spaced recesses along said bottom wall, and said third connecting means including wall surfaces along the bottom of said shelf divider, to be positioned with the bottom wall recess at a preselected location, for securably and adjustably retaining said bottom edge in said bottom wall, with the proximate and distal ends of the shelf divider being connected to said front and rear walls; and said wall surfaces of said third connecting means including a plurality of spaced downwardly extending tabs, and the recesses of said third mounting means including a plurality of adjacent sets of recesses, each such set extending between said front and rear walls of said product shelf, with the spacing between the individual recesses in each set corresponding to the spacing between the individual tabs of said third connecting means, a plurality of such sets being successively spaced between the opposed side edges of said product shelf, whereby the selected engagement between said tabs and recesses establishes the width of the compartments between adjacent ones of said shelf dividers.

21. A product display according to claim 20, wherein:

the product receiving compartments may be of a plurality of different widths.

22. A product display according to claim 21, wherein:

each of said shelf dividers is formed of metal, and has a width in the order of one-sixteenth of an inch.

23. A product display according to claim 21 wherein:

said first connecting means is a bulbous projection along said proximate end and said first mounting means is a resilient channel along said front wall for frictionally retaining said first connecting means at an adjustable preselected location along said front wall; and said second connecting means and second mounting means including cooperating elements for frictionally retaining said distal end of the shelf divider at an adjustable preselected location along said rear wall.

* * * * *